US011646526B2

(12) United States Patent
Burrow

(10) Patent No.: US 11,646,526 B2
(45) Date of Patent: May 9, 2023

(54) CONNECTOR AND METHOD OF MANUFACTURE

(71) Applicant: Siemens Energy Global GmbH & Co. KG, Bayern (DE)

(72) Inventor: Christopher Burrow, Ulverston (GB)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/261,067

(22) PCT Filed: Jul. 31, 2019

(86) PCT No.: PCT/EP2019/070589
§ 371 (c)(1),
(2) Date: Jan. 18, 2021

(87) PCT Pub. No.: WO2020/030487
PCT Pub. Date: Feb. 13, 2020

(65) Prior Publication Data

US 2021/0296813 A1 Sep. 23, 2021

(30) Foreign Application Priority Data

Aug. 6, 2018 (GB) ..... 1812750

(51) Int. Cl.
*H01R 13/523* (2006.01)
*H01R 13/24* (2006.01)
(Continued)

(52) U.S. Cl.
CPC ..... *H01R 13/523* (2013.01); *H01R 13/2421* (2013.01); *H01R 13/2428* (2013.01);
(Continued)

(58) Field of Classification Search
CPC ..... H01R 13/52–523; H01R 13/04–26; H01R 24/58; H01R 43/005;
(Continued)

(56) References Cited

U.S. PATENT DOCUMENTS 1,901,040 A 3/1933 Peroni
3,291,926 A 12/1966 Nelson
(Continued)

FOREIGN PATENT DOCUMENTS

DE 3716205 A1 11/1987
EP 3211726 A1 8/2017
(Continued)

OTHER PUBLICATIONS

International search report and written opinion dated Jan. 30, 2020 for corresponding PCT/EP2019/070589.

*Primary Examiner* — Oscar C Jimenez
*Assistant Examiner* — Paul D Baillargeon
(74) *Attorney, Agent, or Firm* — Wolter Van Dyke Davis, PLLC

(57) ABSTRACT

An electrical connector having a first connector part and a second connector part, the first connector part with at least one electrically conductive pin and the second connector part with at least one shuttle pin, the conductive pin having two or more electrically conductive cores, each conductive core being provided with an external electrical contact and an insulating material forming a watertight seal with the conductive core and the electrical contact. The conductive cores include two or more cores spaced from one another to form the conductive pin. Facing surfaces of the two or more cores are spaced by an air gap with insulating material in the air gap and overmoulded insulating material is in contact with other surfaces of the conductive cores.

20 Claims, 10 Drawing Sheets

(51) Int. Cl.
*H01R 24/58* (2011.01)
*H01R 43/00* (2006.01)
*H01R 43/18* (2006.01)

(52) U.S. Cl.
CPC ..... *H01R 24/58* (2013.01); *H01R 43/005* (2013.01); *H01R 43/18* (2013.01)

(58) Field of Classification Search
CPC H01R 13/2421; H01R 13/2428; H01R 43/18; E21B 17/028; E21B 33/0385; E21B 43/128; E21B 17/003; E21B 17/023; E21B 17/07; E21B 33/035; E21B 33/04; E21B 10/32; E21B 10/322; E21B 17/02; E21B 17/021; E21B 17/026; E21B 17/042; E21B 17/1035; E21B 19/006; E21B 19/08; E21B 21/00; E21B 21/106; E21B 23/02; E21B 23/04; E21B 23/06; E21B 33/038; E21B 33/12; E21B 34/02; E21B 41/00; E21B 43/01; E21B 43/126; E21B 47/00; E21B 47/12; E21B 47/13; E21B 47/135; E21B 47/14; E21B 7/28; H02G 15/117; H02G 15/14; H02G 15/18; H02G 15/22; H02G 15/23; H02G 15/24; H02G 1/08; H02G 1/10; H02G 1/145; H02G 3/22; H02G 9/065; H01B 13/221; H01B 7/1805; H01B 7/04
See application file for complete search history.

(56) References Cited

U.S. PATENT DOCUMENTS

| | | | | |
|---|---|---|---|---|
| 5,171,158 | A | 12/1992 | Cairns | |
| 5,203,805 | A | 4/1993 | Cairns | |
| 5,484,296 | A | 1/1996 | Taylor | |
| 6,140,905 | A * | 10/2000 | Shoji | H01M 50/572 337/407 |
| 6,796,850 | B2 * | 9/2004 | Matsui | H01R 13/2421 439/700 |
| 7,648,401 | B2 * | 1/2010 | Guenther | A61N 1/056 439/669 |
| 7,695,301 | B2 * | 4/2010 | Mudge, III | H01R 13/533 439/271 |
| 9,028,264 | B2 * | 5/2015 | Head | H01R 13/00 439/140 |
| 9,101,776 | B2 * | 8/2015 | Hughes | A61N 1/3752 |
| 9,157,561 | B2 * | 10/2015 | Martin | F16L 37/35 |
| 9,748,688 | B2 * | 8/2017 | Hagmann | H01R 13/5213 |
| 10,181,692 | B2 * | 1/2019 | Flaherty, IV | H01R 4/304 |
| 10,209,460 | B2 * | 2/2019 | Tucker | G02B 6/3821 |
| 2010/0210146 | A1 | 8/2010 | Jang | |
| 2014/0213118 | A1 | 7/2014 | Glynn | |

FOREIGN PATENT DOCUMENTS

| | | | |
|---|---|---|---|
| EP | 3082943 | B1 | 2/2018 |
| WO | 2006031478 | A1 | 3/2006 |

* cited by examiner

FORCE
DISPLACEMENT
FORCE
DISPLACEMENT
1
2
3
4
5
6
7
8
9
10
11
12
13
14
15
16
17
18
19
20
100

CONNECTOR AND METHOD OF MANUFACTURE

CROSS REFERENCE TO RELATED APPLICATIONS

This application is the US National Stage of International Application No. PCT/EP2019/070589 filed 31 Jul. 2019, and claims the benefit thereof. The International Application claims the benefit of United Kingdom Application No. GB 1812750.6 filed 6 Aug. 2018. All of the applications are incorporated by reference herein in their entirety.

FIELD OF INVENTION

This invention relates to a connector, in particular an underwater, or subsea, connector and a method of manufacturing the connector.

BACKGROUND OF INVENTION

Single electrical contact, or single band, connectors, for example down-hole electrical connectors are well known. The electrical contact, or band, may be, for example, for analogue or digital communications, relatively low voltage or current, such as control signals, or relatively high voltage or current, such as power. However, it is desirable to be able to provide an electrical connector which allows for more than one electrical contact to be made using the same connector, for example for dual band or multi-band connectors for communication, or to enable both power and signal cabling to use the same connector.

SUMMARY OF INVENTION

In accordance with a first aspect of the present invention, an electrical connector comprising a first connector part and a second connector part, wherein the first connector part comprises at least one electrically conductive pin and the second connector part comprises at least one shuttle pin; the conductive pin comprising two or more electrically conductive cores, each conductive core being provided with an external electrical contact and an insulating material forming a watertight seal with the conductive core and the electrical contact; wherein. the conductive cores comprise two or more cores spaced from one another to form the conductive pin; wherein facing surfaces of the two or more cores are spaced by an air gap with the insulating material in the air gap and overmoulded insulating material is in contact with other surfaces of the conductive cores.

During assembly, the insulating material around the cores and in the airgap between the cores shrinks onto the conductive cores to form a watertight seal with the cores.

Each electrical contact may further comprise a contact surface, the contact surfaces being clear of insulating material.

The contact surfaces may be flush with an external surface of the insulating material.

The electrical contacts may comprise one circumferential contact, extending around the complete circumference of the conductive pin; and one or more semi-contacts, wherein the semi-contacts extend over only a fraction of the circumference of the conductive pin; or a plurality of semi-contacts, wherein the semi-contacts extend over only a fraction of the circumference of the conductive pin.

The conductive cores may comprise two or more spaced cores having substantially identical form.

The cores are spaced from one another to form the conductive pin.

The conductive cores may comprise one or more flat surfaces, spaced from one another to form the conductive pin.

The conductive cores may comprise at least two flat surfaces, the surfaces being orthogonal, or separated by an angle of 120°.

The insulating material may comprise an organic thermoplastic polymer, in particular polyether ether ketone, or polyaryl ether ketone.

The external surface of the conductive pin may be substantially smooth.

In accordance with a second aspect of the present invention, a method of manufacturing a conductive pin for a connector according to the second aspect; the method comprising forming two or more conductive cores, assembling the conductive cores, spaced from one another, in a moulding tool with their electrical contacts, applying molten insulation material in the space between the conductive cores and between the conductive cores and the electrical contacts; and over-moulding the conductive cores and electrical contacts with a layer of insulating material.

The method may further comprise applying a substantially equal thickness of insulating material over the surface of the conductive pin and removing insulating material from the contact surfaces until the contact surfaces are substantially flush with an outer surface of the insulating material of the conductive pin.

In accordance with a third aspect of the present invention, a connector comprises a first connector part and a second connector part, wherein the first connector part comprises at least one conductive pin and the second connector part comprises at least one shuttle pin; wherein the second connector part further comprises a nested shuttle pin return spring comprising a first spring, a second spring and a coupling device to couple the first and second spring together.

In accordance with a fourth aspect of the present invention, a connector according to the first aspect wherein the second connector part further comprises a nested shuttle pin return spring comprising a first spring, a second spring and a coupling device to couple the first and second spring together.

The shuttle pin may comprise a hollow cylindrical body, open at one end, having a shuttle pin inner diameter and the coupling device comprises a hollow cylindrical body, open at one end having an outer diameter less than or equal to the shuttle pin inner diameter.

The first spring may have a first extended length and the second spring may have a second extended length and the first extended length may be greater than or equal to half of the second extended length.

The coupling device may comprise a single cylinder. With a suitable length of cylinder and springs of the same length, this is particularly effective in reducing the overall compressed length.

In another embodiment, the coupling device may comprise a telescopic cylinder comprising two or more tubular sections, wherein the fully retracted cylinder has an overall length less than the overall length of the fully extended cylinder.

BRIEF DESCRIPTION OF THE DRAWINGS

An example of a shuttle pin arrangement and receptacle pin for a connector and associated method of manufacture in accordance with the present invention will now be described with reference to the accompanying drawings in which.

DETAILED DESCRIPTION OF INVENTION

For down hole applications, connectors which make a single electrical contact are well known. However, designing a reliable connector with multiple electrical contacts for use in down hole situations is more complex. U.S. Pat. No. 9,270,051B1 describes an example of a wet mate connector in which a male pin with multiple electrical contacts and a female pin with a plurality of female contacts are provided. For operators who already have many single contact connectors installed, it is desirable to be able to provide a connector with multiple contacts that is compatible with existing single band connectors. This may comprise a multi-contact plug which is configured to be able to mate to a single contact receptacle pin in an existing down hole interface.

Multiple contact connectors may have an increased mating stroke as compared to a single contact connector and then the shuttle pin and shuttle pin return spring are also required to accommodate an increased stroke. This can be a problem where internal space is constrained. When designing a connector in which a multiple contact connector interface is to be made compatible with an existing single band interface, this leaves little internal space to accommodate an increased stroke.

The present invention addresses this problem by means of a nested shuttle pin return spring. The shuttle pin in the plug part of a connector acts to close and seal the connector when two parts of the connector are taken apart and allows the connection to be made when the two parts of the connector come together, without ingress of seawater, or loss of internal dielectric medium, typically oil. In order to increase the stroke to cater for the multi contact pin design, springs are used to allow for a greater number of bends in the available space. The packaging of the springs is designed to accommodate an increased mating stroke inside the original single band space envelope, or to decrease the overall length of any plug connector.

Figures 1A, 1B, 2A, 2B:
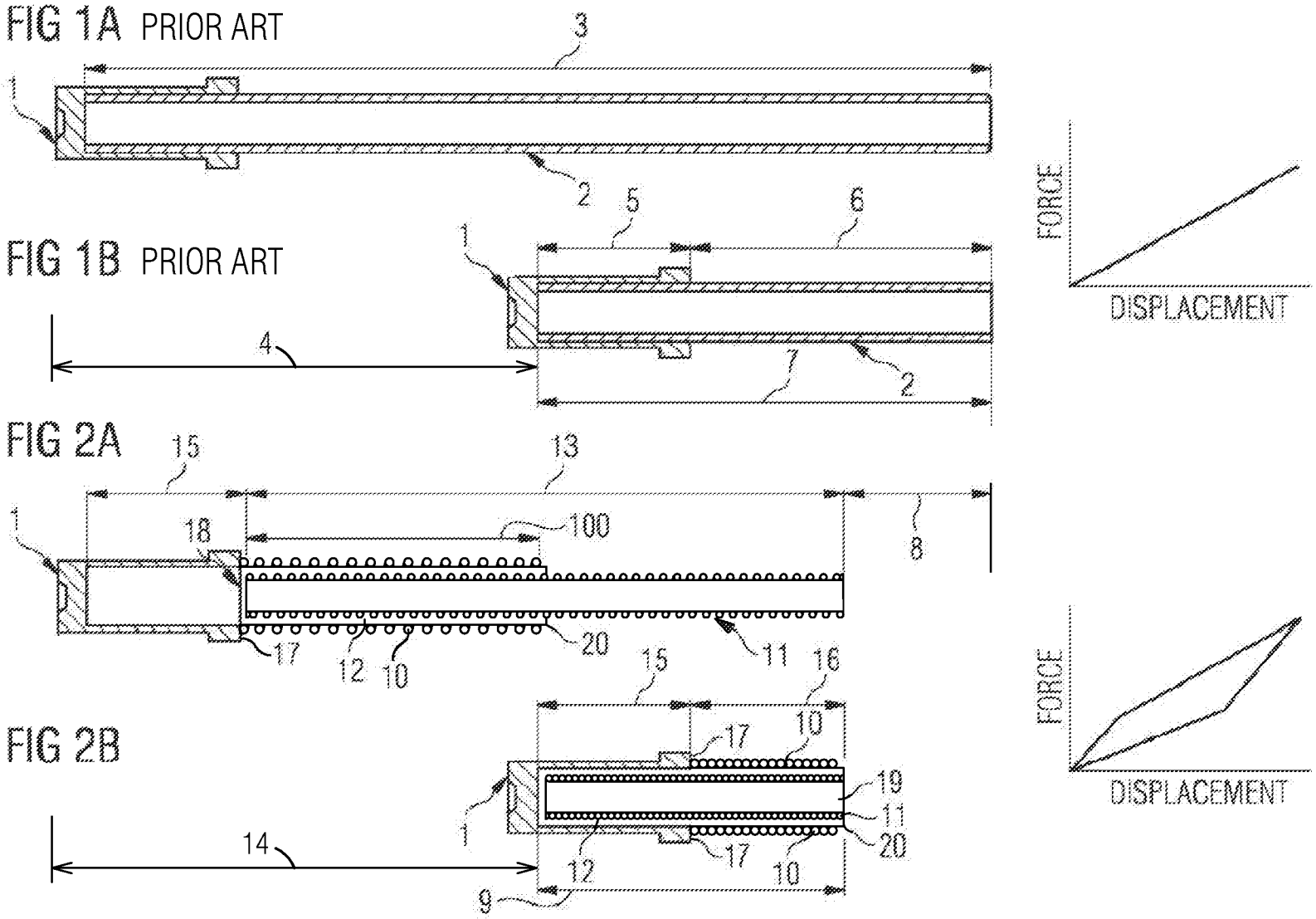
FIG 1A PRIOR ART
FIG 1B PRIOR ART
FIGS. 1*a* and 1*b* illustrate the space requirement for a standard coil spring arrangement for a shuttle pin of a connector.
FIGS. 2*a* and 2*b* illustrate one example of a shuttle pin and spring arrangement for a connector in accordance with the present invention, using a nested coil spring arrangement.

FIGS. 1*a* and 1*b* illustrate examples of a conventional spring arrangement for a shuttle pin, when extended (FIG. 1*a*) and when compressed (FIG. 1*b*). A shuttle pin 1 is mounted for movement on a standard spring 2. In the example, the standard spring has an extended length 3 of 60 units and a mate stroke 4 of 30 units. In its compressed state, the spring 2 has a total compressed length 7 of 30 units, i.e. a compression ratio of 2:1, of which 10 units of compressed length 5 is within the shuttle pin 1 and 20 units of compressed length 6 sticks out.

By comparison, FIG. 2*a* shows a nested spring arrangement according to the present invention when extended and FIG. 2*b* shows that arrangement when compressed. FIGS. 2*a* and 2*b* show a nested spring arrangement according to the invention, used with the same shuttle pin 1. In its extended form, a first spring 10 is mounted in contact at one end with an end face 17 of the shuttle pin 1. A second spring 11, having a smaller diameter than the diameter of the first spring 10, is mounted inside the first spring and extending from a point level with the end face 17 to a point remote from the end face 17, beyond the end of the first spring 10, away from the shuttle pin. For example, the second spring, when extended, may be about twice the length of the first spring, when extended. A coupling tube 12 couples the end of the first spring remote from the end face 17 to the end of the second spring closest to the end face 17. In its compressed form, the second spring 11 is within the coupling tube 12 and partially within the shuttle pin 1. In their extended form, neither spring is within the shuttle pin, the only contact being between the end face 17 and one end of the first spring 10.

The coupling tube comprises a closed end 18, an open end 19 and a flange 20 by which force applied by the second spring to the closed end of the coupling tube is transmitted to the first spring. The coupling tube may have an outer diameter substantially equal to an inner diameter of the shuttle pin (assuming a substantially cylindrical shuttle pin inner surface). However, as compression springs grow fractionally in diameter when compressed, it is advantageous to design in a sufficient clearance between the mating surfaces to prevent binding. As the second spring 11 is compressed it forces the coupling tube into the shuttle pin and force passes through the flange of the coupling tube to the first spring 10 to compress that. A cylindrical inner surface is the most convenient shape in most cases, although non-cylindrical shapes are not excluded. If the shuttle pin has a non-cylindrical inner surface, the coupling tube outer may be adapted accordingly to be sized, so that it is able to slide in and out of the shuttle pin.

In the example shown in FIG. 2*a*, the first spring 10 has an extended length 100 of 20 units and the second spring 11 has an extended length 13 of 40 units. As with the standard spring of FIGS. 1*a* and 1*b*, a mate stroke 14 of 30 units is assumed. The internal length 15 of the shuttle pin is 10 units, the overall length of the shuttle pin 1 is 10.25 units and so the combination of the shuttle pin 1 and extended second spring 11 in this example is 50.25 units. A distance 8 of the reduction in overall length is 9.75 units in this example, when compared with the conventional spring arrangement at 60 units. The nested spring arrangement of FIGS. 2*a* and 2*b* maintains this reduction when compressed. Under compression, the second spring pushes the closed end 18 of the coupling tube 12 into the shuttle pin 1, so that at least part of the coupling tube 12 and second spring 11 move into the shuttle pin 1. The flange 20 of the coupling tube engages with the end of the first spring 10 remote from the end face 17, so that the first spring 10 is compressed and reduces in length as the second spring is compressed and at least a part of the second spring 11 is held within the shuttle pin and the compressed first spring. Consequently, during at least an initial portion of a mate stroke, the hollow cylindrical body of the coupling tube 12 is configured to experience increasing tension in response to at least one of an increasing compression of the first spring 10 and an increasing compression of the second spring 11. The length 16 of the first spring when compressed is 10 units and the length 9 of the second spring when compressed is 20 units. In this way, the overall length, when compressed, in this example, can be reduced to 20.25 units, with the same compression ratio of 2:1. Only 10.25 units are left protruding from the shuttle pin, rather than 20 units in the example of FIG. 1*b*. This is 9.25 units less than with a standard spring arrangement. Thus, the reduction in the compressed length that sticks out is nearly 50%, allowing a more compact connector to be built.

The example length values given for the uncompressed and compressed lengths of the springs are not limiting and may be adapted to the requirements of a particular connector, but an overall reduction in the length that sticks out from the shuttle pin after mating of about 50% can be expected, as compared to the same connector using a standard spring and a reduction of about $\frac{1}{3}^{rd}$ in the length required for the longest spring may be achieved.

Figure 3A:
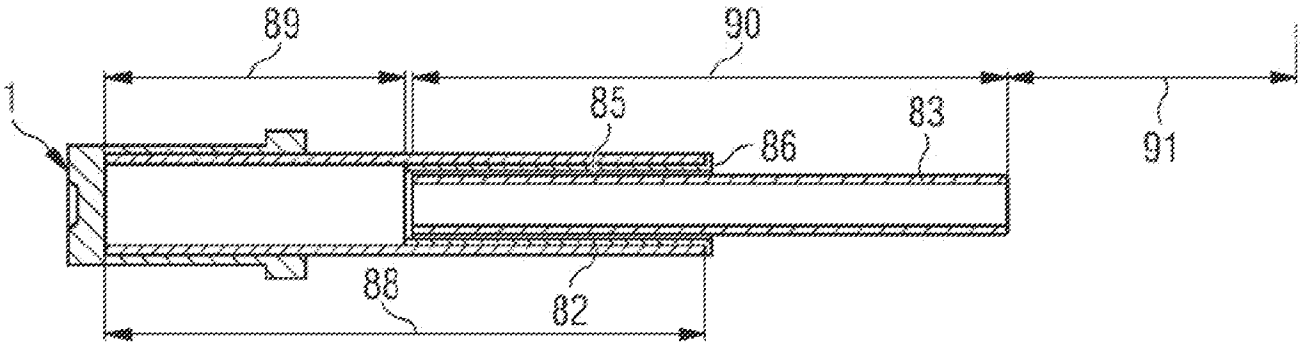
FIGS. 3*a* and 3*b* illustrate another example of a connector in accordance with the present invention, using a nested coil spring arrangement.
Figure 3B:
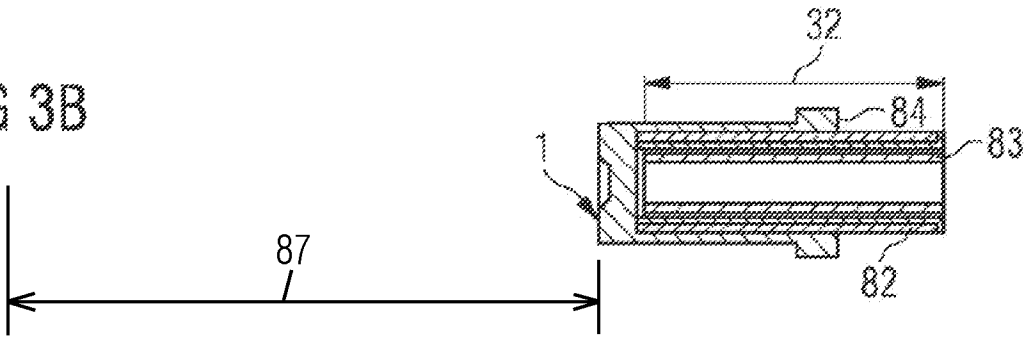

A further reduction in overall compressed length may be achieved using two springs of the same length with a coupling tube as shown in FIGS. 3*a* and 3*b*. In this arrangement, shown in FIG. 3*a* a first spring 82 is provided extending from the shuttle pin 1 and a second spring 83 within a coupling tube 85 having a flange 86 by which the springs are coupled together. The diameter of the shuttle pin 1 may be increased, as compared to the examples of FIG. 2, or the diameter of the springs 82, 83 may be reduced to fit within a standard shuttle pin. The overall length 32 of the coupling tube may be chosen to be less than the example of FIGS. 2*a* and 2*b*. For a similar example, i.e. a stroke length 87 of 30 units, an extended spring length 88, 90 of 30 units for both springs, a spacing 89 of 15 units between a base of the coupling tube 85 and the end of the spring 83 within the shuttle pin and a similar length shuttle pin 1, it is possible to achieve a reduction 91 in compressed length (FIG. 3*b*) of about 70% compared to the standard shuttle pin and spring of FIGS. 1*a* and 1*b*.

Figure 4A:
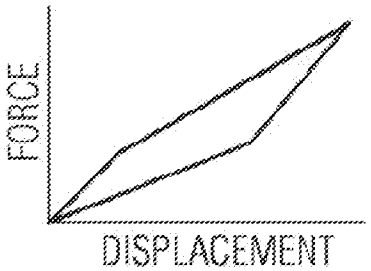
FIGS. 4*a*, 4*b* and 4*c* illustrate an alternative example of a connector in accordance with the present invention, using a nested coil spring arrangement.
Figure 4A:
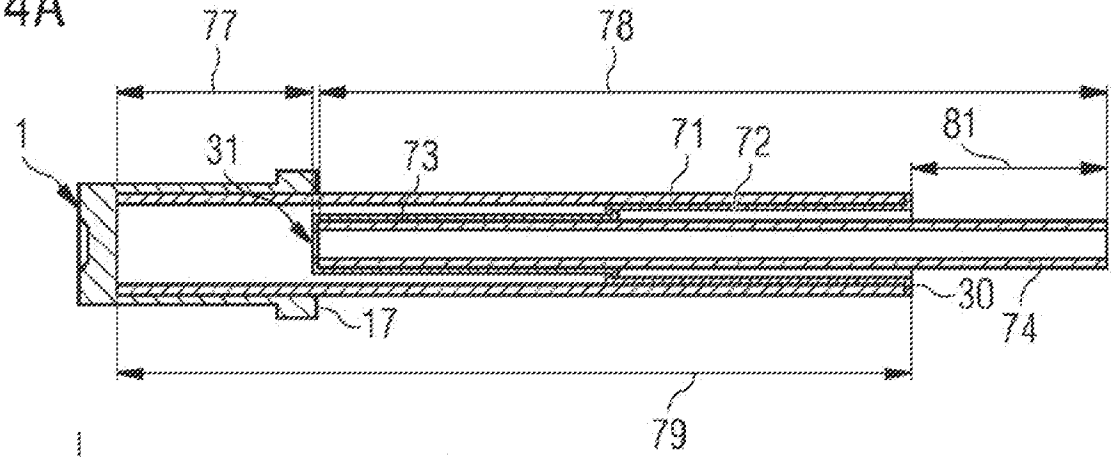
Figure 4B:
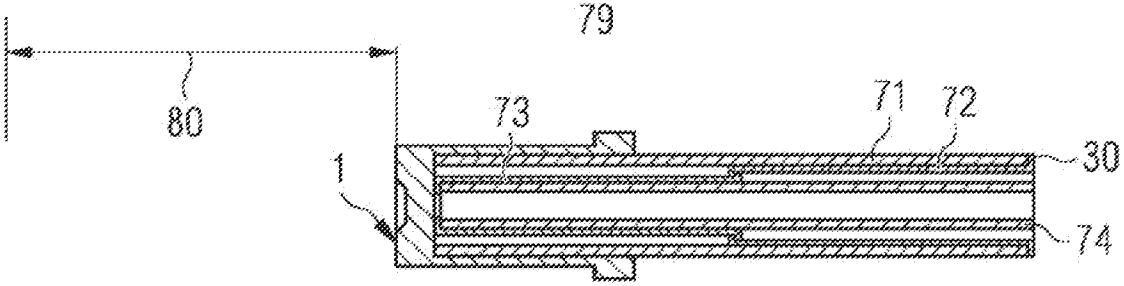
Figure 4C:
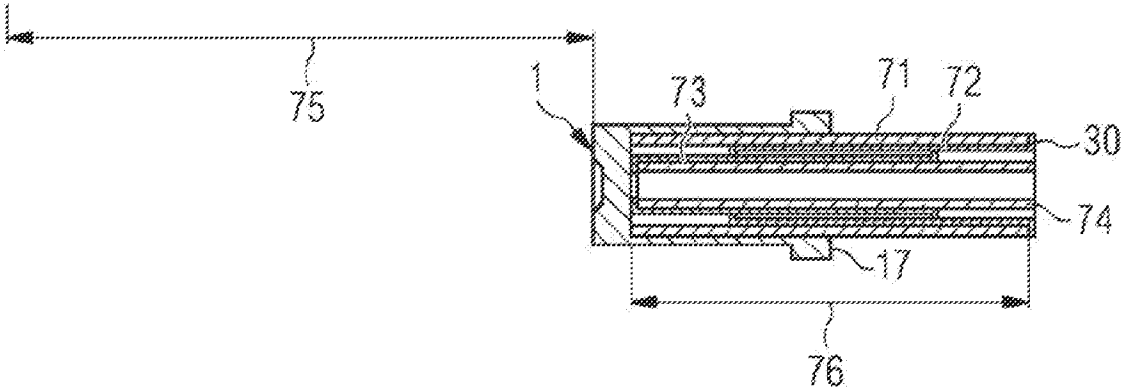

Another way to reduce overall compressed length, as compared to a standard arrangement, is to use a multipart coupling tube comprising, for example two tubes, one of which partially nests within the other when compressed, as shown in FIGS. 4*a*, 4*b* and 4*c*. This is particularly useful for springs with a small diameter relative to their length and in cases where the lengths are not the same. In the example of FIG. 4*a*, one end the first spring 71 is mounted within the shuttle pin 1. At the opposite end, a flange 30 of a multi-part coupling 72, 73 is provided in contact with the spring 71. In this example, the coupling comprises two parts 72, 73. A second spring 74 is mounted within the coupling 72, 73. In a first compression stage, shown in FIG. 4*b*, the spring 74 applies a force on the coupling 72, 73 forcing the base 31 of the coupling into the shuttle pin and causing the flange 30 of the coupling in contact with the spring 71 to compress that spring. In a second compression stage, an outer part 72 of the coupling slides over an inner part 73 of the coupling until the spring 71 is fully compressed, as shown in FIG. 4*c*. A telescopic tube may be substituted for the single coupling tube illustrated for FIGS. 2 and 3, although in general the single fixed tube is advantageous for those examples, as it reduces complexity in manufacture.

Figure 5A:
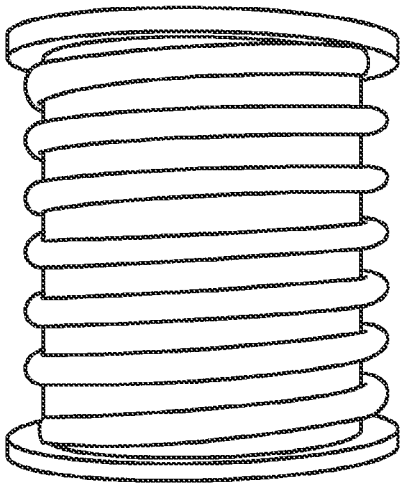
FIGS. 5*a* to 5*d* illustrate the extent of further space saving made possible using a wave spring by contrast with a coil spring.
Figure 5B:
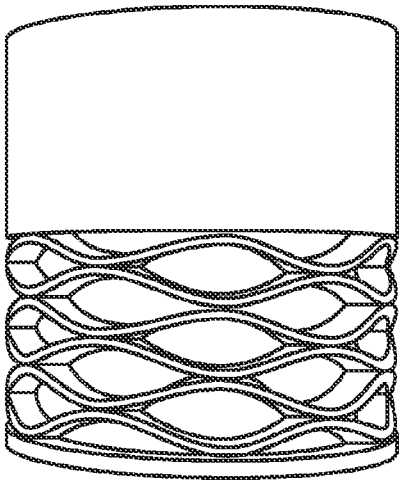
Figure 5C:
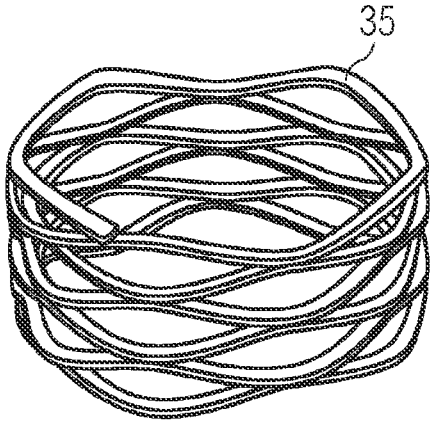
Figure 5D:
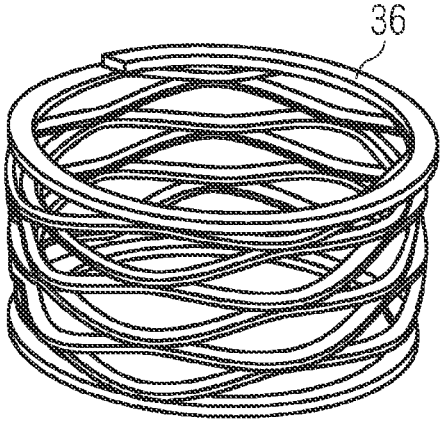

In the examples of FIGS. 2, 3 and 4 above, the dual springs cause a step change in overall rate of change of force with distance, as compared to the standard, linear, relationship of the example of FIG. 1. This is illustrated beside the examples of FIGS. 2 and 4. The step change has the advantage of allowing the rate at the position where the shuttle pin is pushed through the front seal 94—see FIG. 6—towards the end of the de-mate stroke, to be increased, reducing the likelihood of the shuttle pin sticking. The springs may take the form of a traditional coil spring, a wave spring, or other energy storing mechanical configuration, such as bellows storing pressure for conversion to force. However, most alternatives give rise to increased complexity, when compared with springs. Wave springs are particular useful in further reducing the overall connector length, as compared to using coil springs. FIG. 5*a* illustrates a conventional coil spring on a former and FIG. 5*b* illustrates a wave spring on the same former, indicating the length required with a wave spring to achieve the same compressive force may about half that required by a conventional spring. Wave springs may take various forms, examples of which are illustrated in FIG. 5*c* with a non-uniform boundary edge 35 and FIG. 5*d*, with a uniform boundary 36. A uniform boundary is convenient for getting an even distribution of force from the flange 20 of the coupling 12 onto the spring.

Figure 6:
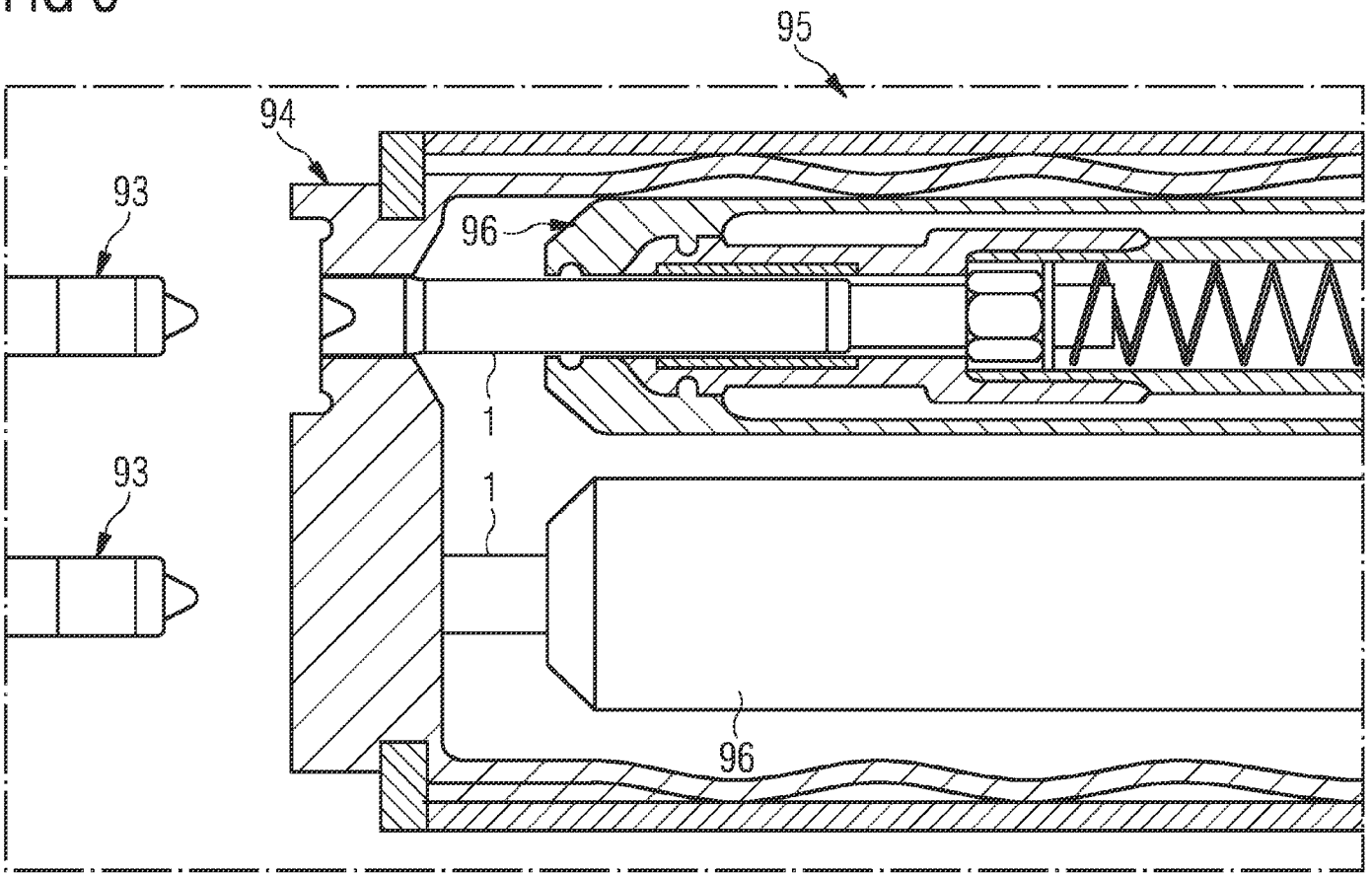
FIG. 6 illustrates an example of a plug and receptacle connector showing a receptacle pin before it engages with a shuttle pin in the plug.

FIG. 6 illustrates how a shuttle pin is mounted within a typical plug 95 of a connector and how it operates with a receptacle pin. A receptacle pin 93, when connected first engages with the shuttle pin 1, then passes through a first seal 94 into an oil chamber of the primary diaphragm and pushes back the shuttle pin. The receptacle pin continues to push the shuttle pin and enters a secondary diaphragm 96 and then makes full contact with the plug socket.

The nested shuttle pin return mechanism described above may be used inside a typical plug arrangement of the type shown in FIG. 6, so can be retrofitted in the space of existing connectors. The arrangement reduces the lengthwise footprint as compared to a typical single spring arrangement and assists in accommodating the increased mating stroke required for a multi band pin within the single band pin space constraint. Adding one or more extra bands results in an increased mating stroke to accommodate the longer dual, or multi-band pin, which is addressed in the design of the present invention.

Figure 7:
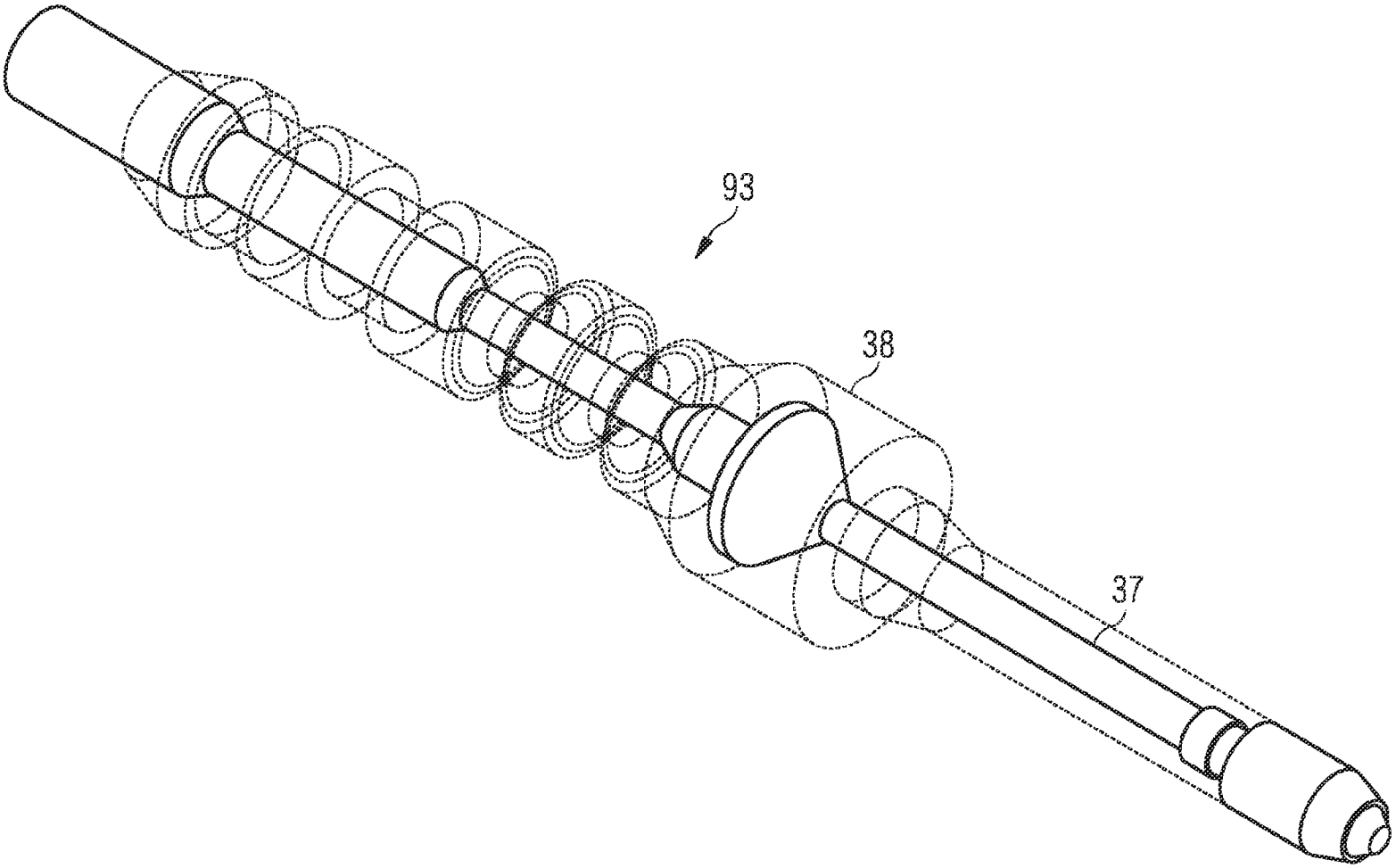
FIG. 7 illustrates an example of a single core receptacle pin overmoulded with an insulator.

Another aspect of multi-band, or multi contact, connectors is that there needs to be a way to electrically connect the correct contacts on either side of the connector correctly. There are various alternatives to enable this to be done. As shown in FIG. 7, the receptacle pin 93 is typically manufactured by overmoulding with an insulating material 38, typically an organic thermoplastic polymer, such as polyaryletherketone (PEEK), onto a longitudinal copper core pin 37. Other insulators, such as epoxy, or ceramic, may be used, but PEEK is advantageous. The core pin comprises a series of cylindrical or conical sections of different diameters typically formed by bar feed turning, or other turning process suitable for long slender pins which do not have the rigidity to self-support when only supported at their ends during manufacture. The changes in diameter or wall angle are required in order to address the different requirements of load shoulder versus electrical stress management. The PEEK over-moulding 38 generally follows the external shape of the core pin 37, so that the cylindrical nature of the core pin is well matched to the cylindrical nature of the PEEK over-moulding. This type of core pin and over-moulding arrangement facilitates one electrical path per pin, or single band operation. Conventionally, dual band, or two electrical paths per core, has been obtained by using coaxial conductors, such as a solid metal core and a surrounding woven metal sheath, separated by an insulator. However, reliably over-moulding the insulator on both pins without creating a leak path is difficult and for multi core contacts, even more so.

Figure 8B:
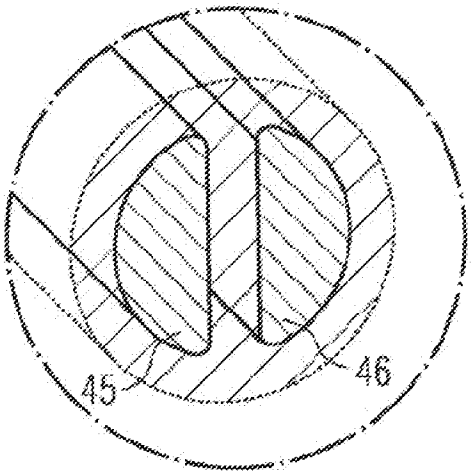
FIG. 8*a* shows a core pin with longitudinal split into halves and FIG. 8*b* is a cross sectional view of FIG. 8*a* taken at 8B-8B.
Figure 8A:
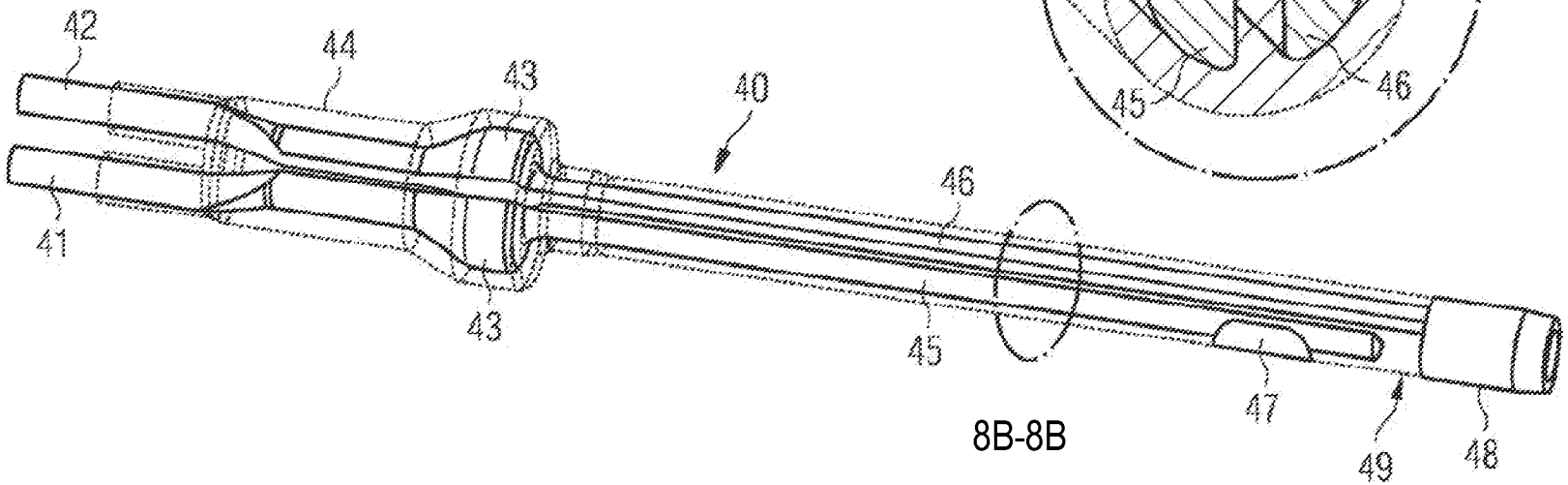

Dual band, or multi-band operation, needs two, or more than two, electrical paths per pin. FIG. 8*a* shows a first example of a core pin 40 adapted to provide two electrical paths per pin. FIG. 8*b* is a cross sectional view taken at 8B-8B. At one end, the individual electrical paths can be seen as two separate cores 41, 42, each with an enlarged section 43 for stress relief. The geometry of the pin is chosen to give a relatively large cross-section of pin, whilst keeping the wall thickness of the insulator relatively uniform thickness, in order to cope with differential shrinkage of the PEEK and copper during cooling after overmoulding, without opening up gaps, or voids, which raise electrical stress. As can be seen in more detail in the expanded cross-section, each core after the section 43 has a D-shaped, or semi-circular cross-section 45, 46, separated by a gap, also filled with PEEK during overmoulding, to prevent shorting. The conductor cores 45, 46 are provided with electrical contacts 47, 48, also separated by a gap, filled with PEEK, by which the cores make electrical contact when the pin is inserted into the socket (not shown). The complete pin is over-moulded with PEEK 44 as a single piece. The PEEK may then be machined back to expose the metal for the external electrical contacts 47, 48. The resulting conductive pin may have a substantially smooth surface.

Figure 9:
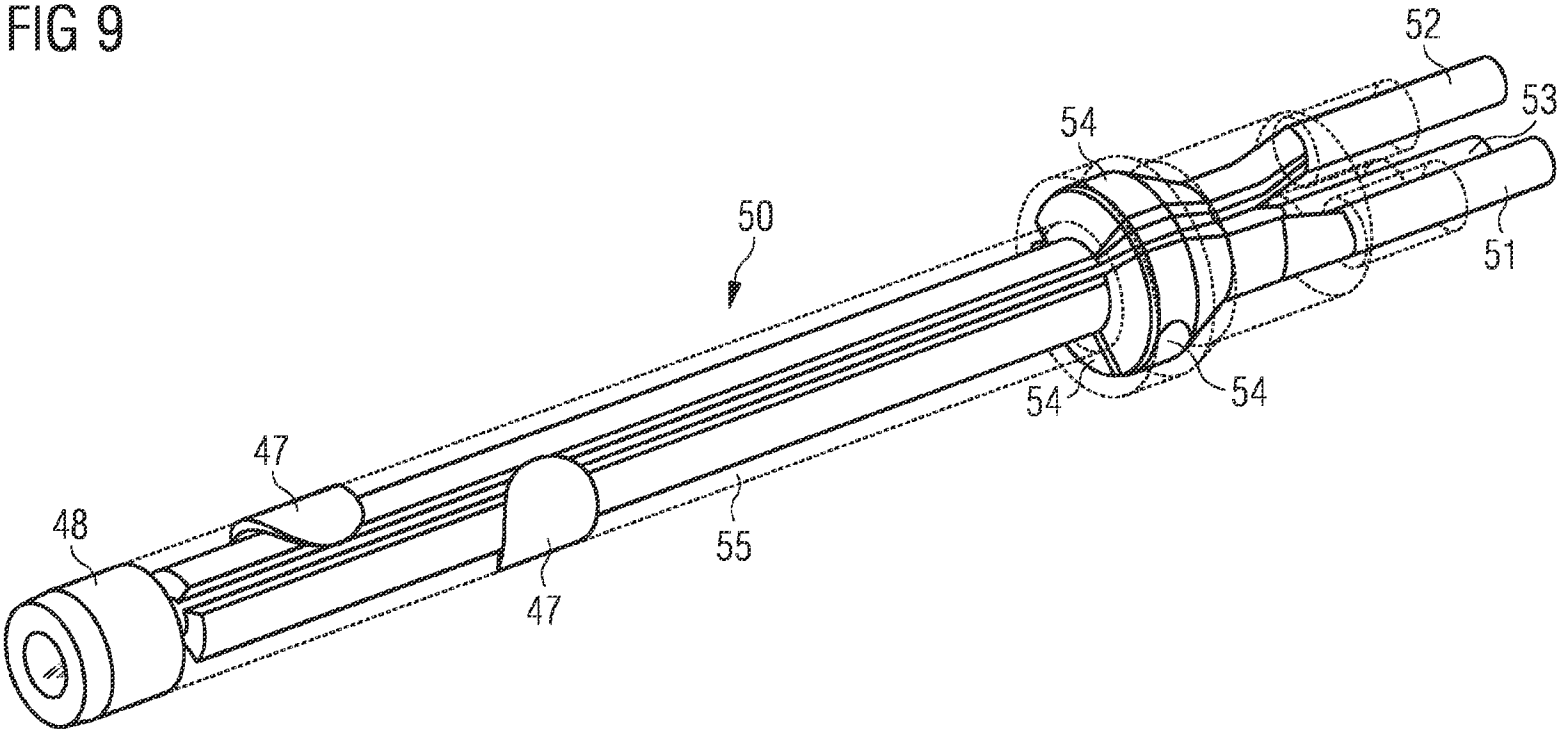
FIG. 9 shows an example of a triple core pin arrangement.

An example of a three-core pin 50 is illustrated in FIG. 9. Here, the core is split into thirds. Thus, multiple bands are made possible by splitting a single core pin longitudinally into two or more conductors, as shown in FIGS. 8 and 9, whilst retaining the same approximate overall geometry. The two or more cores may have a substantially identical form comprising halves or thirds of a rotationally symmetrical complete article, flat surfaces of the halves or thirds being spaced from one another to form the complete electrically conductive pin. For a three core, or four core pin, there may be two flat surfaces on each core and for a two core pin, a single flat surface on each core. The angle of the two flat surfaces relative to each other is determined by the total number of cores that form a pin, so, for example, the flat surfaces may be at 90° or 120° to one another for a four core, or three-core pin, respectively.

Figure 10A:
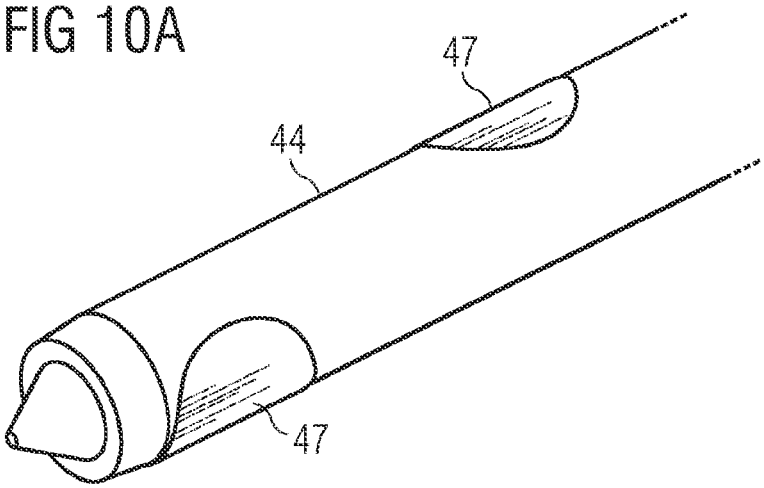
FIG. 10*a* illustrates a semi contact pair.
Figure 10B:
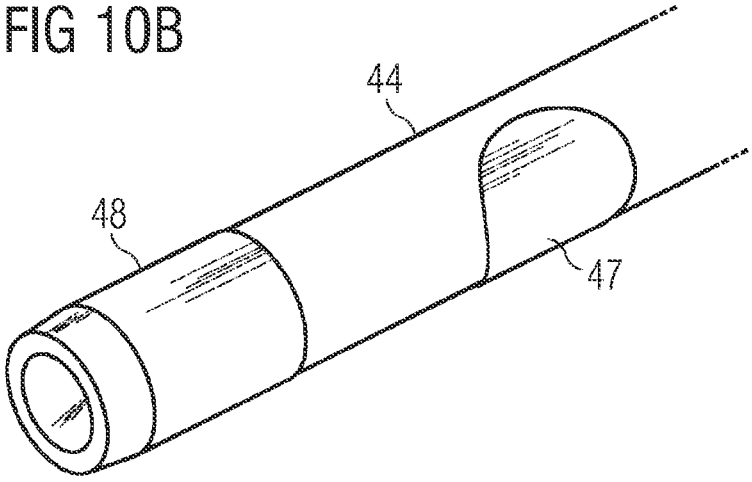
FIG. 10*b* illustrates a semi contact combined with a conventional tip contact.
Figure 10C:
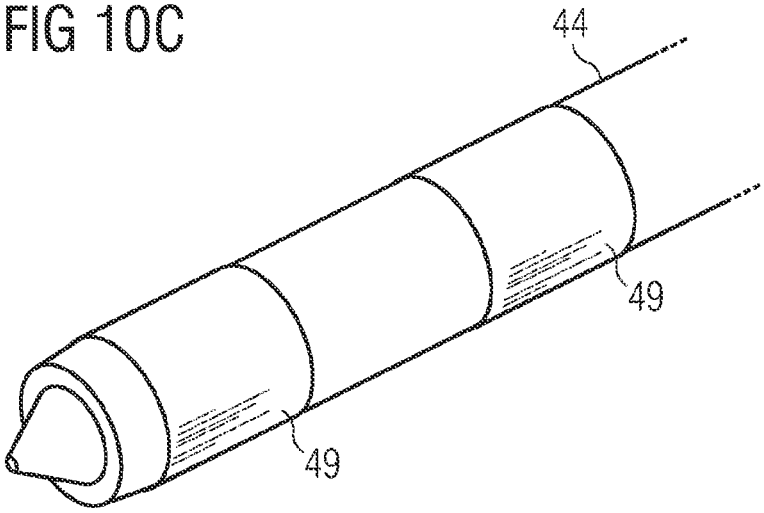
FIG. 10*c* illustrates a ring contact arrangement.

In the example of FIG. 9, three conductor cores 51, 52, 53 are provided, each having flat surfaces facing equivalent surfaces on the adjacent cores, the surfaces being separated by an air gap into which insulating material is forced during the over-moulding process. As before, the complete pin is over-moulded with PEEK 55 as a single piece and the PEEK machined back to expose the contact surfaces. In the example shown, partial contacts 47 provide the contact surface for two of the cores and a tip contact 48 provides the third contact surface. Other combinations are illustrated in FIGS. 10*a*, 10*b* and 10*c*. FIG. 10*b* shows an example with one contact 47 being a semi-contact, and the other contact 48 being a tip contact. FIG. 10*a* shows an alternative, which is to use partial contacts, or semi-contacts 47, to make the all the connections from the conductive cores 45, 46 to contacts on the other part of the connector (not shown). The contacts 47, 48 are typically arranged to be flush with the surface of the insulator 44. The semi-contacts may be arranged to be in line, or diametrically opposite one another, or take any other relative orientation. Arranging two semi-contacts diametrically opposite to one another has the advantage of marginally increasing electrical clearance and creepage distances.

As the semi-contacts 47 do not go around the complete surface of the pin, the corresponding contact on the other side may need to be a full circumferential contact, such as a multilam spring contact in the plug, which avoids the need for rotational alignment to ensure contact. Without a full circumferential contact, there may need to be an alignment mechanism for ensuring the connection is made with the correct orientation for the contacts 47 when both parts of the connector are connected. So, a semi contact, located in the receptacle pin, may be required to mate with a traditional ring contact, located in the plug, if provision for rotational alignment, such as "key in key way", is to be avoided. It is advantageous to avoid rotational alignment between connectors, as this is difficult to retrofit into an existing interface and adds complication in downhole applications where space is at a premium.

In conjunction with the split core pin arrangement and providing physical separation without overlapping, the semi contact of FIGS. 10*a* and 10*b* avoid core pins having to pass inside a ring contact, i.e., coaxially, for example of the type shown in FIG. 10*c*. FIG. 10*c* illustrates two circumferential, or ring, contacts 49, providing a form of coaxial conductor. A ring contact may be a convenient geometry for contact making between connectors, but putting an insulating material, such as PEEK, beneath the underlying coaxial contact annulus is very problematic because PEEK shrinks away from the metal due to the differential shrinkage and opens up a gap below, weakening the structure and creating leak pathways.

As the metal conductive core, typically, copper and the insulator being over-moulded, typically PEEK, have different physical and electrical properties, a short on the PEEK covered pin may cause the pins to crack due to the forces applied by the change in dimensions as the PEEK shrinks post moulding. Axial shrinkage of the PEEK may cause the ends of the PEEK over-moulding to pull away on conventional pin, or a coaxial one. A dual band pin of the type shown in FIG. 5 having two conductor cores 45, 46 may be formed by additive manufacturing, investment casting or machining, along with elements of fabrication as required. The conductor cores are then both put into the over-moulding tool, with the flat surfaces (the diameter of the semicircle in this case) facing one another, with an air gap between, then the two cores are over-moulded together, taking care to maintain the air gap until PEEK fills the gap. To avoid potential problems from shorting, the manufacturing technique forces the insulator into the pin hydraulically during the moulding process, filling the air gaps with insulating material.

The over-moulded outer casing has a substantially constant wall thickness, so follows the shape of the pin cores. As the over-moulded insulator cools and shrinks, it forms a watertight seal. This arrangement works sympathetically with the over-moulding process as the insulator predominantly encapsulates the conductors allowing the core pins to move together as differential rates of shrinkage between the insulator and the metal core after moulding ($\Delta T \sim 380°$) takes effect, without gaps or voids being created. This technique avoids the need for small, weak and hard to assemble moulding components, which occurs with co-axial designs.

The insulator 44 between and around the section 43 creates a load shoulder to deal with differential pressure across the pin, for example, due to well or water pressure differences/changes. The over-moulded insulator is removed to expose the contacts, for example by machining.

For example, the conductive cores may comprise two or more cores having substantially identical form spaced from one another to form the conductive pin. Facing surfaces of the two or more cores are spaced by an air gap and during assembly, are overmoulded with insulating material, so that the insulating material is in contact with the surface of each core and fills the air gap between the facing surfaces, then shrinks independently around the cores, forming the watertight seal with the surfaces of the cores, as the insulating material cools. Overmoulding with a solid insulating material also provides more structural support to the cores than a conventional oil filled cavity would. In practice, there is a limit to the total number of conductive cores of the pins that can be provided using the design of FIGS. 5 and 6, as the conductive cores of the pins become individually too slender and cannot be kept straight during the moulding process. This can be dealt with to some extent by increasing the overall diameter of the multiband pin, so that each individual core can be made thicker and so more robust. For example, for a down hole connector, a typical pin diameter in a range of 5 mm, may, for a dual core pin, become a pin diameter of 6 mm, or even as much as 8 mm. For a larger pin diameter, a proportionate increase in diameter for a dual core pin may be required.

Figure 11:
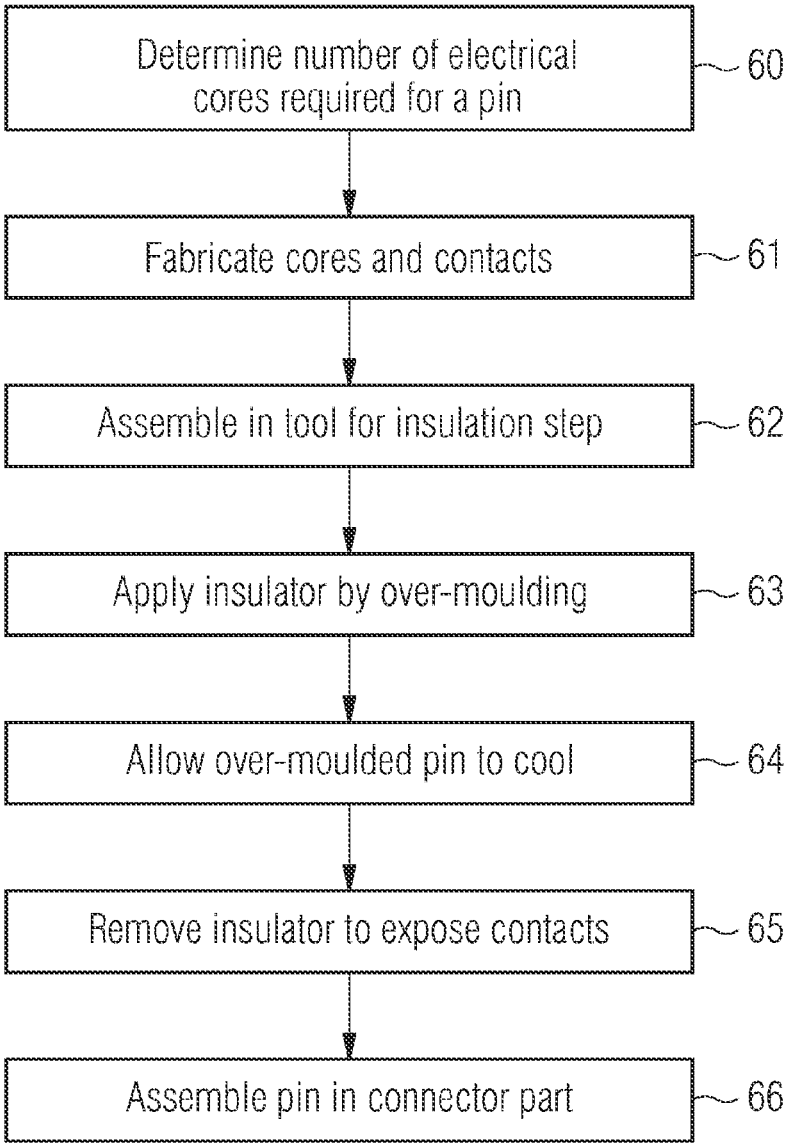
FIG. 11 illustrates an example of a method of manufacturing a connector according to the present invention.

FIG. 11 is a flow diagram of a method manufacturing an electrically conductive pin for a connector according to the present invention. For a specific requirement, the number of electrical cores per pin required is determined 60. The number of cores per pin affects the minimum core thickness and overall dimensions of the pin. The required cores and contacts are fabricated 61. The fabricated parts are assembled 62, with appropriate spacing to prevent contact between individual cores, in an over-moulding tool. The fabrication step 61 may be carried out independently of the determining and assembly steps and appropriately sized parts simply extracted from stores. In the over-moulding tool, the assembled cores and contacts of the pin are overmoulded 63 with insulating material of a substantially constant thickness and further insulating material is forced into air gaps between individual cores and contacts by applying an appropriate pressure to the molten insulator material in the tool. The insulating material is allowed to cool 64 and in so doing shrinks to form a watertight seal with the core. Typically, the thickness of insulating material applied over the surface of the conductive pin is substantially even. Once cool, the insulating material that covers any contacts is removed 65, for example, by machining. Machining also causes blending of the external surfaces of the insulation and contacts preventing steps caused by differential shrinkage. Preferably, the contacts and remaining insulating material are flush with one another leaving a pin of constant external diameter beyond the load shoulder 43, 54. The pin can then be assembled 66 in a receptacle of a connector and in use, cooperates with a corresponding shuttle pin in a plug of the connector.

The nested spring arrangement and a multi-core pin as described above, address the problems of retrofitting multiband connectors into the space envelope of a single band connector, whilst providing a robust and reliable connector. A nested spring arrangement may be used in a connector having multiple receptacle pins and corresponding shuttle pins, as well as in a connector having a receptacle pin with multiple cores, as described herein.

It should be noted that the term "comprising" does not exclude other elements or steps and "a" or "an" does not exclude a plurality. Also, elements described in association with different embodiments may be combined. It should also be noted that reference signs in the claims should not be construed as limiting the scope of the claims. Although the invention is illustrated and described in detail by the embodiments, the invention is not limited by the examples disclosed, and other variations can be derived therefrom by a person skilled in the art without departing from the scope of the invention.

The invention claimed is:

1. A connector comprising:

a first connector part and a second connector part, wherein the first connector part comprises a conductive pin and the second connector part comprises a shuttle pin;

wherein the second connector part further comprises a nested shuttle pin return spring comprising a first spring, a second spring and a coupling device to couple the first and second spring together;

wherein the shuttle pin comprises a hollow cylindrical body, open at one end, comprising a shuttle pin inner diameter and the coupling device comprises a hollow cylindrical body, open at one end comprising an outer diameter less than or equal to the shuttle pin inner diameter, and wherein during at least an initial portion of a mate stroke the hollow cylindrical body of the coupling device is configured to experience increasing tension in response to at least one of an increasing compression of the first spring and an increasing compression of the second spring.

2. The connector according to claim 1, wherein the first spring comprises a first extended length and the second spring comprises a second extended length and the first extended length is greater than or equal to half of the second extended length.

3. The connector according to claim 1, wherein the coupling device comprises a single cylinder.

4. The connector according to claim 1, wherein the coupling device comprises a telescopic cylinder comprising two or more tubular sections, wherein when fully retracted the telescopic cylinder comprises an overall length less than the overall length of the telescopic cylinder when fully extended.

5. The connector according to claim 1, wherein the conductive pin comprises two or more electrically conductive cores, each conductive core being provided with an external electrical contact and an insulating material forming a watertight seal with the conductive core and the external electrical contact.

6. The connector according to claim 5, wherein each electrical contact further comprises a contact surface, the contact surfaces being clear of insulating material.

7. The connector according to claim 6, wherein the contact surfaces are flush with an external surface of the insulating material.

8. The connector according to claim 5, wherein the electrical contacts comprise one circumferential contact, extending around a complete circumference of the conductive pin; and one or more semi-contacts, wherein the one or more semi-contacts extend over only a fraction of the complete circumference of the conductive pin.

9. The connector according to claim 5, wherein the conductive cores comprise two or more cores comprising substantially identical form spaced from one another to form the conductive pin.

10. The connector according to claim 5, wherein the conductive cores comprise one or more flat surfaces, spaced from one another to form the conductive pin.

11. The connector according to claim 5, wherein the conductive cores comprise at least two flat surfaces, the at least two flat surfaces being orthogonal, or separated by an angle of 120°.

12. The connector according to claim 5, wherein the insulating material comprises an organic thermoplastic polymer, or polyether ether ketone, or polyaryl ether ketone.

13. The connector according to claim 5, wherein an external surface of the conductive pin is substantially smooth.

14. A method of manufacturing the connector of claim 1, wherein forming the conductive pin comprises:

forming two or more conductive cores, assembling the conductive cores, spaced from one another, in a molding tool with respective electrical contacts, applying molten insulation material in a space between the conductive cores and between the conductive cores and the electrical contacts; and over-molding the conductive cores and electrical contacts with a layer of insulating material.

15. The method according to claim 14, wherein the method further comprises:

applying a substantially equal thickness of insulating material over a surface of the conductive pin and removing insulating material from contact surfaces until the contact surfaces are substantially flush with an outer surface of the insulating material of the conductive pin.

16. The connector according to claim 1, wherein the first spring comprises a first spring proximate end that is proximate the shuttle pin and a first spring distal end, wherein the second spring comprises a second spring proximate end that is proximate the shuttle pin and a second spring distal end, and wherein the hollow cylindrical body of the coupling device provides a load path between the first spring distal end and the second spring proximate end.

17. The connector according to claim 16, wherein the first spring surrounds the hollow cylindrical body of the coupling device, the hollow cylindrical body of the coupling device surrounds the second spring, and the hollow cylindrical body of the coupling device directly connects the first spring distal end and the second spring proximate end.

18. The connector according to claim 17, wherein the hollow cylindrical body of the coupling device comprises a surface at a first end against which the first spring distal end abuts and a surface at a second end against which the second spring proximate end abuts.

19. A connector comprising:

a first connector part and a second connector part, wherein the first connector part comprises a conductive pin and the second connector part comprises a shuttle pin;

wherein the second connector part further comprises a nested shuttle pin return spring comprising a first spring, a second spring and a coupling device to couple the first and second spring together;

wherein the shuttle pin comprises a hollow cylindrical body, open at one end, comprising a shuttle pin inner diameter and the coupling device comprises a hollow cylindrical body, open at one end comprising an outer diameter less than or equal to the shuttle pin inner diameter; and wherein the coupling device comprises a telescopic cylinder comprising two or more tubular sections, wherein when fully retracted the telescopic cylinder comprises an overall length less than the overall length of the telescopic cylinder when fully extended.

20. A connector comprising:

a first connector part and a second connector part, wherein the first connector part comprises a conductive pin and the second connector part comprises a shuttle pin;

wherein the second connector part further comprises a nested shuttle pin return spring comprising a first spring, a second spring and a coupling device to couple the first and second spring together;

wherein the shuttle pin comprises a hollow cylindrical body, open at one end, comprising a shuttle pin inner diameter and the coupling device comprises a hollow cylindrical body, open at one end comprising an outer diameter less than or equal to the shuttle pin inner diameter; and wherein the conductive pin comprises two or more electrically conductive cores, each conductive core being provided with an external electrical contact and an insulating material forming a watertight seal with the conductive core and the external electrical contact; and wherein the electrical contacts comprise one circumferential contact, extending around a complete circumference of the conductive pin; and one or more semi-contacts, wherein the one or more semi-contacts extend over only a fraction of the complete circumference of the conductive pin.

* * * * *